US005147035A

United States Patent [19]

Hartman

[11] Patent Number: 5,147,035

[45] Date of Patent: Sep. 15, 1992

[54] INTERLOCKING DIMPLE-HINGED DOOR BLISTER PACKAGE

[75] Inventor: Eric E. Hartman, Ridgefield, Conn.

[73] Assignee: Chesebrough-Pond's USA Co., Greenwich, Conn.

[21] Appl. No.: 686,903

[22] Filed: Apr. 17, 1991

[51] Int. Cl.[5] ..... B65D 5/52

[52] U.S. Cl. ..... 206/45.23; 206/815; 206/45.16; 206/470

[58] Field of Search ..... 206/461, 804, 815, 470, 206/45.16, 45.17, 45.23

[56] References Cited

U.S. PATENT DOCUMENTS

| | | | |
|---|---|---|---|
| 3,246,740 | 4/1966 | Guyer | 206/815 X |
| 3,463,309 | 8/1969 | Szostek | 206/470 |
| 4,210,246 | 7/1980 | Kuchenbecker | 206/461 |
| 4,236,637 | 2/1980 | Castner, Sr. et al. | 206/470 X |
| 4,496,052 | 1/1985 | Nertman | 206/461 X |
| 4,739,883 | 4/1988 | Mohs et al. | 206/461 X |
| 4,784,268 | 11/1988 | Perchak | 206/461 |
| 4,884,718 | 12/1989 | Leahy | 206/470 X |
| 4,930,627 | 6/1990 | Borst et al. | 206/45.23 |
| 4,989,730 | 2/1991 | Lemoine | 206/815 X |
| 5,052,560 | 10/1991 | Stringham | 206/815 X |

FOREIGN PATENT DOCUMENTS

| | | | |
|---|---|---|---|
| 0082458 | 6/1983 | European Pat. Off. | 206/461 |
| 3606974 | 11/1986 | Fed. Rep. of Germany | 206/461 |

*Primary Examiner*—Paul T. Sewell
*Assistant Examiner*—Beth Anne Cicconi
*Attorney, Agent, or Firm*—Milton L. Honig

[57] ABSTRACT

A thermoformed reclosable display package is provided having a bubble body, cover independent of the body and hinge through which the cover rotatably attaches to the body. An egress opening for packaged items is formed in the body and is coverable by the hinged cover. A sealing device in the form of a projection-depression are formed in side walls of the blister body and cover for purposes of resecuring the cover onto the body. A pair of opening extension apertures may be cut outwardly along opposite borders of the egress opening. These apertures allow for extraction of product items from within the blister body.

8 Claims, 3 Drawing Sheets

INTERLOCKING DIMPLE-HINGED DOOR BLISTER PACKAGE

BACKGROUND OF THE INVENTION

1. Field of the Invention

The invention relates to a reclosable blister package.

2. The Related Art

Blister packages are characterized by a transparent thermoformed plastic covering bonded to a backing card, to a transparent sheet or similar support material. Small articles such as cotton swabs are particularly suited for containment therein. Consumers can easily view the packaged product prior to purchase.

Removal of the product usually requires the consumer to irreversibly tear open the package. There is advantage to a reclosable blister that minimizes damage to the original container.

U.S. Pat. No. 4,930,627 describes a reclosable display package having a bubble body mounted onto a card. An egress opening is situated on a front face of the body. There is also a cover integral with the body and connected thereto by an integral hinge. The cover is pivotable about the hinge to fully close the egress opening. Pivot of the cover about the integral hinge allows the former to serve as a rear base and support for display of the package in a rearwardly inclined position with the egress opening uncovered. A wedge-shaped depression on the body above the egress opening cooperates with a wedge-shaped projection on the cover to achieve a snap-on seal.

A problem with the known art is that there is only a strong seal along the front face of the cover surrounding the egress opening. Contaminants including dust and dirt however have access to the product. Sterile products such as cotton swabs or the like need greater protection than available from this known art.

Another problem with the art as found in U.S. Pat. No. 4,930,627 is the difficulty in restraining or extracting product items from the egress opening. For instance, in the display position cotton swab sticks will, as a mass, tumble out of a too large opening. On the other hand, constriction of the opening to prevent such occurrence will cause difficulty in extracting sticks.

Accordingly, it is an object of the present invention to provide a blister package having a reclosable cover over a front face egress opening, the cover being hingedly attached to a backing card and rotatable to support the latter for standing in an up-right position.

Another object of the present invention is to provide a blister package having a reclosable cover sealable along each face thereof.

An additional object of the present invention is to provide a blister package of the aforementioned type with an egress opening that in the display position is designed to prevent product items from falling out while still allowing ready extraction thereof.

A still further object of the present invention is to provide a blister package of the aforementioned type having greater support along the hinged base which contacts the rear of the backing card.

These and other objects of the present invention will become more evident through the following drawing and detailed description.

SUMMARY OF THE INVENTION

A thermoformed blister of flexible plastic material for a closable blister card display package is provided which includes a bubble body and a cover independent of the body and connected to a flange of the body by integral hinge. The bubble body is formed with an article compartment; top, left, right and bottom peripheral flanges for sealing to a backing card to close the article compartment; a body front face including a portion defining an egress opening in the body front face; left and right body side walls perpendicularly flanking the body front face; and a device on each of the left and right body side walls for forming a seal.

The cover includes a cover front face; a device on the cover front face for sealing that face to the body front face; a left and right cover side wall; and a device on each of the left and right cover side walls for forming a seal, the sealing device of respective left and right cover and body side walls cooperating with one another.

Advantageously, the sealing device cooperating between cover and body side walls may be in the form of a projecting button engaging a matchingly contoured depression on an adjacent side wall. The button when formed on the cover will project inwardly toward a depression in the body side wall. Alternatively, the button may be formed on the body projecting outwardly toward a depression in the cover side wall. It is also advantageous for the projection depression sealing device to be positioned astride the egress opening, preferably midway between upper and lower borders of the egress opening.

The sealing device on the cover front face is preferably locked adhesively to the body front face. A concavely curved tab may be situated at an upper edge of the cover front face. Adhesive can be attached therebelow to lock with the body front face. Alternatively or in addition there could also be employed a pressure-sensitive label to seal during shipment.

In the display position, product items unless restrained may tend to tumble out of the egress opening. Prevention of this possibility is achieved with an an opening whose border is slightly smaller than that required for an item to pass therethrough. A pair of opening extension apertures are cut outward along opposite borders of the egress opening. These apertures provide sufficient length to permit one at a time extraction of a product item.

BRIEF DESCRIPTION OF THE DRAWING

The aforementioned aspects of the present invention will become more apparent from the following detailed description taken in conjunction with the accompanying drawing showing a preferred embodiment wherein.

DETAILED DESCRIPTION

Figure 1:
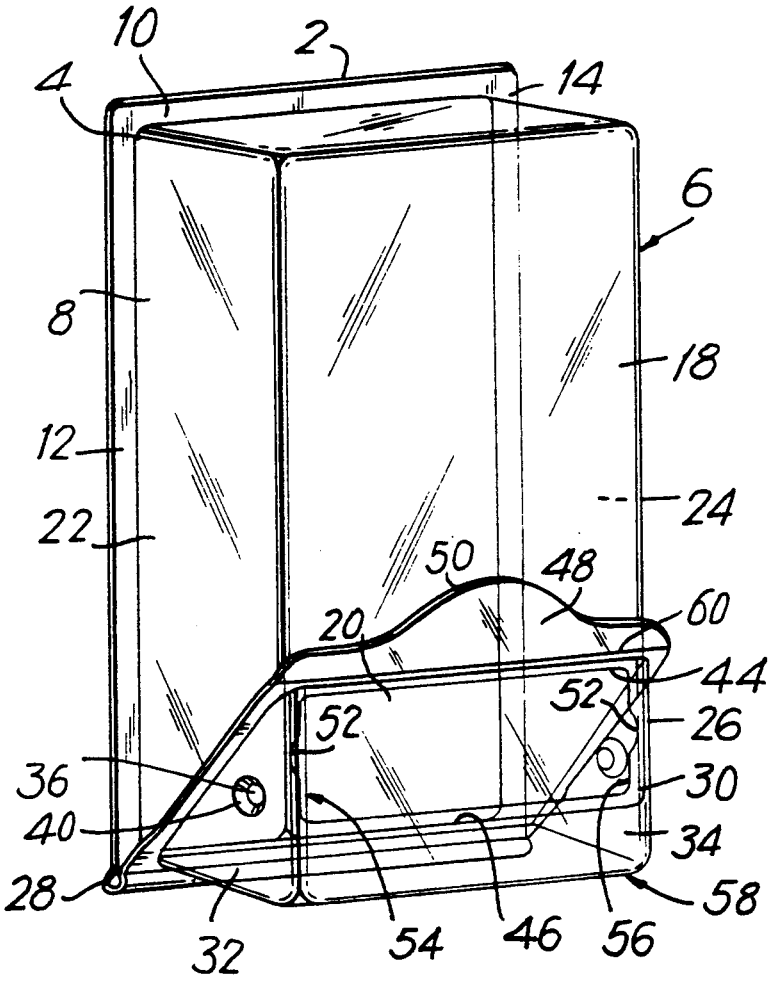
FIG. 1 is a perspective view showing the closed position of the blister package of the invention.
Figure 2:
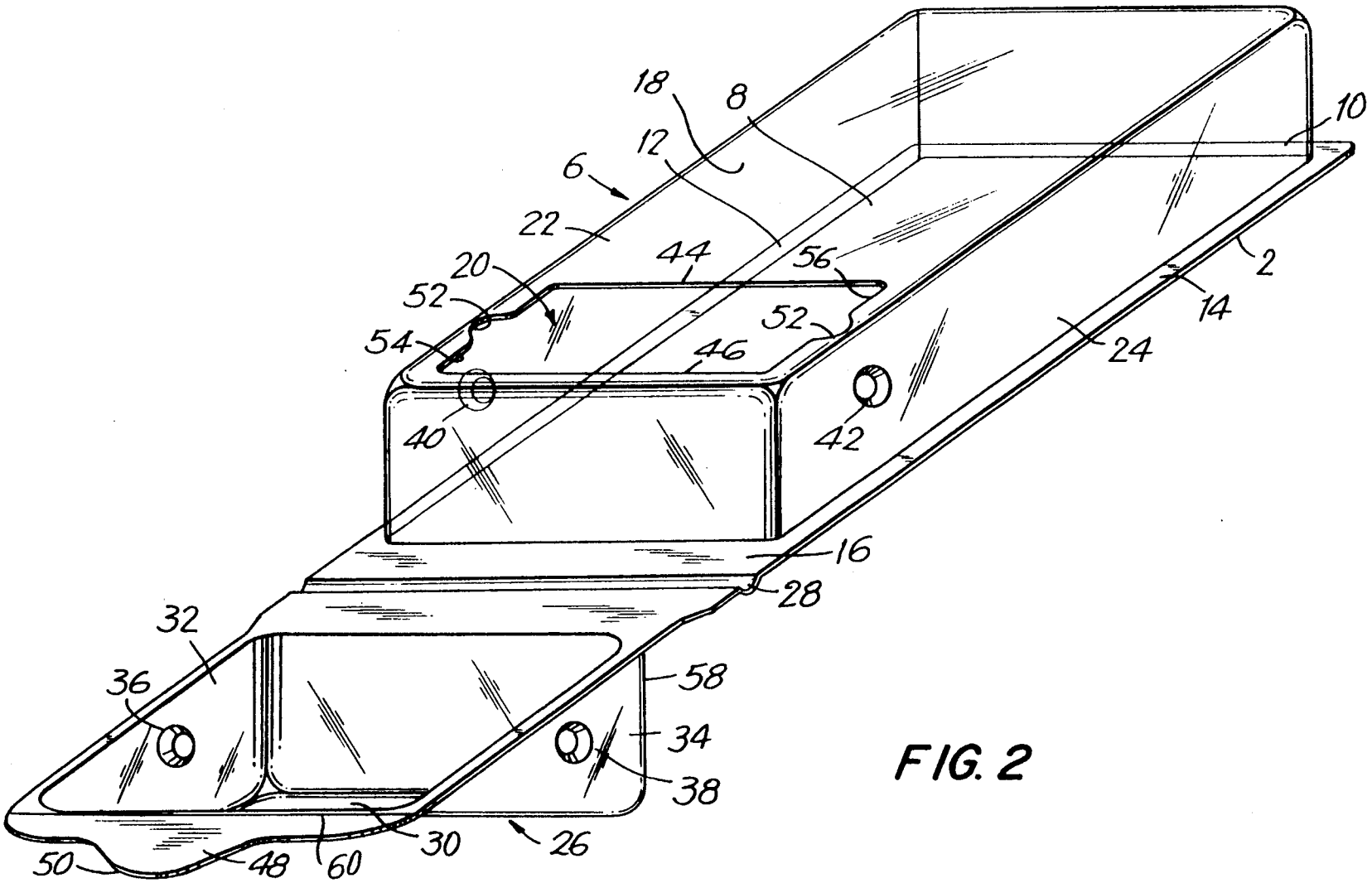
FIG. 2 is a perspective view of the package of FIG. 1, but illustrating an open position.

The blister package of this invention is formed from a backing card 2 bonded to a thermoformed blister 4. The blister includes a bubble body 6 having an article compartment 8, a top flange 10, a left flange 12, a right flange 14 and a bottom flange 16. Additionally, the bubble body includes a body front face 18 having a portion defining an egress opening 20, as well as left and right body side walls 22, 24 flanking the body front face 18.

A rotatable cover 26 is connected by an integral hinge 28 to bottom flange 16 of bubble body 6. Cover 26 does not form part of body 6, but is independent thereof. The cover 26 comprises a body front face 30, a left cover side wall 32 and a right cover side wall 34. Body and cover front faces 18 and 30, respectively, lie in substantially the same plane when the package is in the closed position illustrated in FIG. 1.

Integral hinge 28 depends from bottom flange 16 and has with proviso a roughly C-shaped cross section. When cover 26 is closed over the egress opening 20 and bottom flange 16 is affixed to backing card 2, the length of the integral hinge 28 will extend slightly backwards beyond the plane of backing card 2. Cover 26 may be repeatedly rotated about the integral hinge 28 to cover or reveal the egress opening 20.

An inwardly projecting button 36, 38 is formed in each of the cover side walls 32, 34. Matchingly contoured depressions 40, 42 in the body side walls 22, 24 cooperate with the respective projecting button 36, 38 to achieve a snap-in seal. Best sealing results can be obtained by locating depressions 40, 42 astride 20, approximately midway between upper and lower borders 44, 46 of the opening thereof.

Cover front face 30 is adhesively sealed to body front face 18 at the juncture under tab 48. Preferably tab 48 is convexly upwardly curved and located at an upper edge 50 of cover front face 30.

Egress opening 20 is dimensioned to be smaller in its width than that required for a product item, e.g. a cotton swab stick, to pass therethrough. A pair of apertures 52 are cut outward along opposite borders 54, 56 of the egress opening. The apertures permit one by one removal of the product item from the container compartment.

Figure 3:
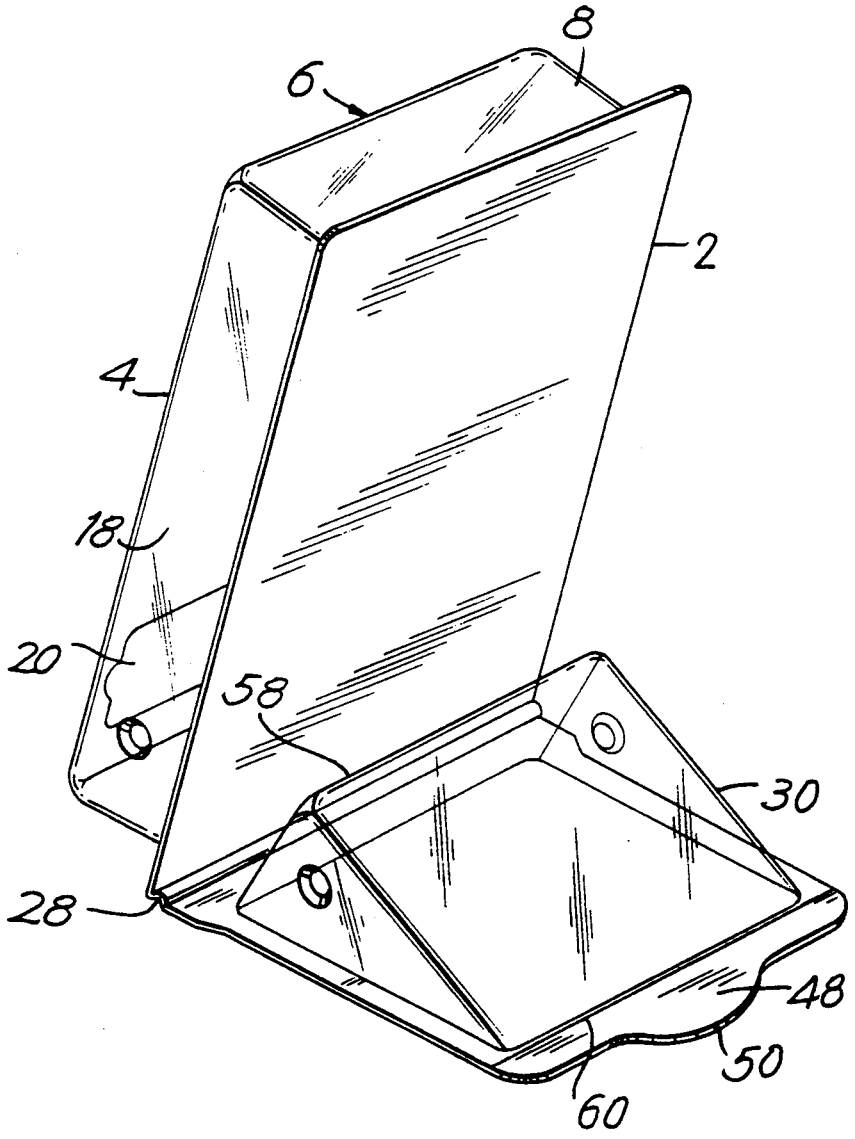
FIG. 3 is a rear perspective view of the package of FIG. 1, but showing an open, up-right, inclined position.

When a consumer folds down the cover 26 there is ready access to the articles contained within the package through the egress opening 20. A consumer may fold the cover backwards around the integral hinge 28 until planar portions 58 meet the rear of the backing card 2. The cover then serves to support the open package in a backwardly inclined upright position, as shown in FIG. 3, for ready inspection and access to the package contents by consumers.

It is to be understood that the invention in its broader aspects is not limited to the specific elements shown and described, but also includes within the scope of the accompanying claims any departures made from such elements which do not sacrifice its chief advantages.

What is claimed is:

1. A thermoformed blister of flexible plastic material for a reclosable blister card display package to contain cotton swab sticks having a predetermined length comprising:

(a) a bubble body comprising (i) an article compartment for holding a plurality of cotton swab sticks;

(ii) top, left, right and bottom peripheral flanges for sealing to a backing card to close the article compartment;

(iii) a body front face including a portion defining an egress opening in the body front face, said egress opening being slightly smaller than the predetermined length to enable said cotton swab sticks to pass therethrough, a pair of opening extension apertures being cut outward along opposite borders of said egress opening, said apertures being of a spaced apart dimension greater than the predetermined length to permit individual extraction of said cotton swab sticks from said compartment;

(iv) left and right body side walls each having a respective outer surface and perpendicularly flanking the body front face;

(v) means on each of the left and right body side walls for forming a seal; and (b) a cover independent of the body and connected to a flange of the body by an integral hinge, the cover comprising (i) a cover front face;

(ii) a means on the cover front face for sealing that face to the body front face;

(iii) a left and right cover side wall each having an inner surface, said respective inner surface being engageable and contacting a respective one of said outer surfaces of said left and right body side walls;

(iv) means on each of the left and right cover side walls for forming a seal, the sealing means of respective left and right cover and body side walls cooperating with one another, and said sealing means being a projecting button engaging a matchingly contoured depression.

2. The package of claim 1 wherein said sealing means cooperating between cover and body side walls is a projecting button engaging a matchingly contoured depression.

3. The package of claim 1 wherein the button is formed on the cover and projects inwardly toward said depression which is in the body side wall.

4. The package according to claim 1 wherein the button is formed on the body and projects outwardly toward said depression which is formed in said cover side wall.

5. The package according to claim 1 wherein said projecting button engaging said matchingly contoured depression is positioned astride said egress opening.

6. The package according to claim 5 wherein said projecting button engaging said matchingly contoured depression is positioned midway between upper and lower borders of said egress opening.

7. The package according to claim 1 wherein said sealing means on said cover front face is attached adhesively to said body front face.

8. The package according to claim 1 further comprising a convexly curved tab situated at an upper edge of said cover front face.

* * * * *

UNITED STATES PATENT AND TRADEMARK OFFICE

CERTIFICATE OF CORRECTION

PATENT NO. : 5,147,035

DATED : September 15, 1992

INVENTOR(S) : Hartman

It is certified that error appears in the above-indentified patent and that said Letters Patent is hereby corrected as shown below:

Title page, item [73],

"Assignee" Section, "Chesebrough-Pond's USA Co.," should read

-- Chesebrough-Pond's USA Co., Division of Conopco, Inc. --.

Signed and Sealed this

Thirty-first Day of May, 1994

*Attest:*

Bruce Lehman

BRUCE LEHMAN

*Attesting Officer*

*Commissioner of Patents and Trademarks*